United States Patent [19]

Toyoshi et al.

[11] Patent Number: 4,897,331

[45] Date of Patent: Jan. 30, 1990

[54] REVERSAL IMAGE FORMING METHOD

[75] Inventors: Naoki Toyoshi; Hiroshi Okamoto; Kenji Tabuchi; Kaoru Takebe; Tomoaki Yokoyama, all of Osaka, Japan

[73] Assignee: Minolta Camera Kabushiki Kaisha, Osaka, Japan

[21] Appl. No.: 201,215

[22] Filed: Jun. 2, 1988

[30] Foreign Application Priority Data

Jun. 3, 1987 [JP] Japan ..... 62-140493
Jun. 12, 1987 [JP] Japan ..... 62-147336

[51] Int. Cl.[4] ..... G03G 13/16; G03G 13/22
[52] U.S. Cl. ..... 430/100; 430/126
[58] Field of Search ..... 430/100, 126

[56] References Cited

U.S. PATENT DOCUMENTS 3,038,799 6/1962 Metcalfe et al. ..... 430/100
3,549,447 12/1970 Breswick ..... 430/126 X
3,773,507 11/1973 Sato et al. ..... 430/100
4,579,443 4/1986 Abuyama et al. ..... 355/4
4,582,417 4/1986 Yagasaki et al. .
4,752,802 6/1988 Ito et al. ..... 355/3 DP

FOREIGN PATENT DOCUMENTS 950767 11/1864 Canada .
61-256357 3/1986 Japan .

*Primary Examiner*—Roland E. Martin
*Attorney, Agent, or Firm*—Burns, Doane, Swecker & Mathis

[57] ABSTRACT

By utilizing an electrophotographic image forming process, a reversal image can be obtained in the following manner:

charging a photosensitive member;

forming an electrostatic latent image in a charged surface of the photosensitive member;

developing the electrostatic latent image formed on the photosensitive member by using white toner;

charging the photosensitive member again;

developing the surface of the photosensitive member by using other toner different in color from the white toner; and transferring the toner image formed on the photosensitive member onto a paper sheet.

4 Claims, 5 Drawing Sheets

REVERSAL IMAGE FORMING METHOD

BACKGROUND OF THE INVENTION

1. Field of the Invention

The present invention generally relates to a method of forming an image, and more particularly, to a method of forming a reversal image by utilizing an electrophotographic image forming process.

2. Description of the Prior Art

Conventionally, both positive and negative microfilms are each used as an original document in a reader printer or the like. Accordingly, such an apparatus is provided with both the function for regular development and that for reversal development so that a positive image or a negative one may be obtained from either the positive microfilm or the negative one.

However, a copying apparatus is only capable of copying in the regular development in which a positive image is formed from a positive original document. If a negative image can be obtained from a positive original document in the copying apparatus, a variety of images being attractive in design can greatly enhance the utility value of the copying apparatus.

However, if both the functions of regular and reversal developments are given to the copying apparatus, the apparatus is inevitably formed into a large size undesirably at an increased cost.

More specifically, if a photoreceptor drum is electrostatically charged in either the positive or negative polarity, it is necessary to selectively use two kinds of differently polarized toners for the regular or reversal development, with these toners contained in respective developing devices. Furthermore, two high-voltage power sources are necessarily required to switch the polarity of electric voltage applied to a charge wire of a transfer charger.

If the copying apparatus is provided with a photoreceptor drum which can be electrostatically charged selectively in either of both polarities, it is necessary to provide two chargers and two high-voltage power sources for switching the polarity of electric voltage applied to the charge wires of respective chargers.

SUMMARY OF THE INVENTION

Accordingly, the present invention has been developed with a view to substantially eliminating the above described disadvantages inherent in the prior art image forming method, and has for its essential object to provide an improved reversal image forming method whereby a reversal image can be formed by making use of a copying apparatus having the same construction as that of the conventional one.

In accomplishing this and other objects, a reversal image forming method according to one preferred embodiment of the present invention is executed as follows:

charging a photosensitive member;
forming an electrostatic latent image in a charged surface of the photosensitive member;
developing the electrostatic latent image formed on the photosensitive member by using white toner;
charging the photosensitive member again;
developing the surface of the photosensitive member by using other toner different in color from the white toner; and
transferring the toner image formed on the photosensitive member onto a paper sheet.

In another aspect of the present invention, the reversal image can be also obtained in the following manner:

charging a photosensitive member;
uniformly developing a charged surface of the photosensitive member by using first toner;
transferring the first toner image formed on the photosensitive member onto a paper sheet;
charging the photosensitive member again;
forming an electrostatic latent image in the charged surface of the photosensitive member;
developing the electrostatic latent image formed on the photosensitive member by using second toner different in color from the first toner; and
transferring the second toner image formed on the photosensitive member onto the paper sheet having thereon the first toner image.

BRIEF DESCRIPTION OF THE DRAWINGS

This and other objects and features of the present invention will become more apparent from the following description taken in conjunction with the preferred embodiment thereof with reference to the accompanying drawings, throughout which like parts are designated by like reference numerals, and in which.

DETAILED DESCRIPTION OF THE PREFERRED EMBODIMENT

Figure 1:
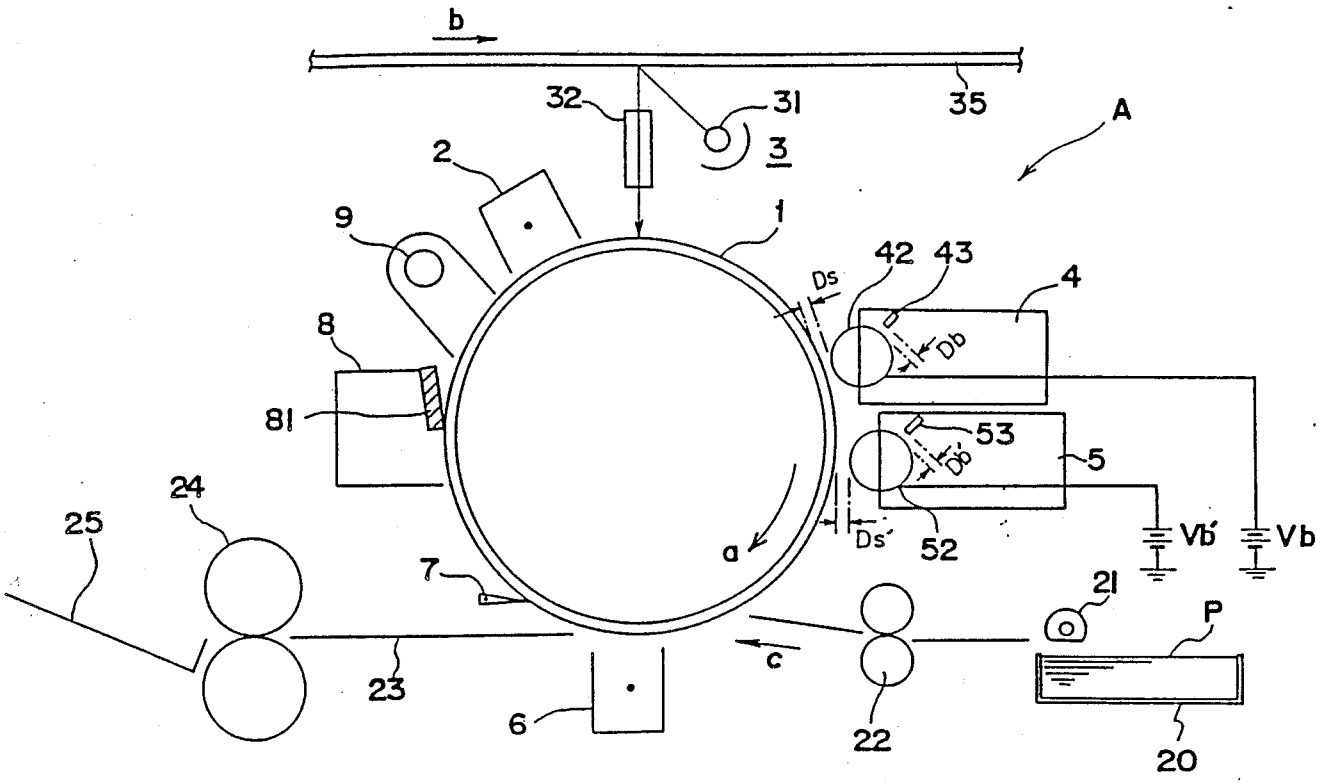
FIG. 1 is a schematic sectional view of a copying apparatus explanatory of a reversal image forming method according to a first embodiment of the present invention.

Referring first to FIG. 1, an electrophotographic copying apparatus A is internally provided substantially at its central portion with a known electrophotographic photoreceptor drum or photosensitive member 1 having a photoconductive layer on its outer periphery and rotatable in a direction as shown by an arrow (a). The copying apparatus A further accommodates, along the periphery of the photoreceptor drum 1, a charger 2, an image exposure device 3, a first developing device 4, a second developing device 5, a transfer charger 6, a separating claw piece 7, a cleaning device 8 and an eraser lamp 9 in a direction of rotation of the photoreceptor drum 1. A paper feed portion 20 and a paper discharge portion 25 are disposed respectively on the right and left sides of the photoreceptor drum 1 as viewed in FIG. 1.

The charger 2 functions as a device for imparting an electrostatic charge (the positive electrostatic charge in this embodiment) in a fixed electrostatic potential to the surface of the photoreceptor drum 1.

The image exposure device 3 applies light to an original document placed on a glass-made document platform 35 capable of scanning in a direction of an arrow (b) so that an electrostatic latent image corresponding to an image of the original document may be formed on the surface of the photoreceptor drum 1 through the known slit exposure method. The image exposure device 3 is comprised of an exposure lamp 31, a series of arrayed lenses juxtaposed with a converging optical transmitting member and the like.

Each of the first and second developing devices 4 and 5 changes the electrostatic latent image formed on the surface of the photoreceptor drum 1 into a visible toner image through the magnetic brush method. The first developing device 4 is provided with a developing sleeve 42 and a bristle height regulating member 43 and accommodates developer including white toner. The second developing device 5 is provided with a developing sleeve 52 and a bristle height regulating member 53 and accommodates another developer including black toner. Both the developing sleeves 42 and 43 are caused to confront the photoreceptor drum 1. The bristle height regulating members 43 and 53 regulate the amount of developer adhering to the surface of the developing sleeves 42 and 52, respectively. The first and second developing devices 4 and 5 are selectively driven during a reversal image forming mode which will be later described.

There are various kinds of known methods of selectively driving a plurality of developing devices.

In a certain method, on condition that a plurality of developing devices are movably supported with respect to the photoreceptor drum, any desired developing device is selectively caused to approach the photoreceptor drum 1.

In another method, a plurality of magnetic poles are so disposed within a developing sleeve as to be rotatable by a predetermined angle. In this method, one of the magnetic poles is caused to confront the photoreceptor drum during the development. In contrast, a location between adjacent two magnetic poles is caused to confront the photoreceptor drum, when the development is not executed.

In a further method, bias voltage applied to the developing sleeve is raised to a higher level when the development is not executed than during the development.

U.S. Patent application Ser. No. 59,850, now U.S. Pat. No. 4,752,902, discloses the above-mentioned methods in detail, and therefore, a further description will be omitted.

Developer consists of magnetic carrier and insulating toner, both of which are electrostatically charged in opposite polarities through their mutual friction. In this embodiment, the insulating toner is charged in the negative polarity opposite to the polarity of the charger 2. Such developer is transported in a known manner and develops the electrostatic latent image formed on the surface of the photoreceptor drum 1.

The transfer charger 6 imparts electric field with respect to a copy paper sheet P from its rear side, which is supplied towards the photoreceptor drum 1 in a direction of an arrow (c). The transfer charger 6 transfers the toner image formed on the surface of the photoreceptor drum 1 by the developing device 4 or 5 onto the copy paper sheet P.

The separating claw piece 7 separates the copy paper sheet P from the photoreceptor drum 1 immediately after the transfer and can swivel about its fulcrum so that its distal end may move away from the photoreceptor drum 1.

The eraser lamp 9 erases, for the next copying operation, the electrostatic charge remaining on the surface of the photoreceptor drum 1 by applying light thereto.

The cleaning device 8 is provided with a cleaning blade 81 for scraping the remaining toner from the surface of the photoreceptor drum 1. The cleaning blade 81 is brought into contact with the photoreceptor drum 1 or is caused to move away therefrom by virtue of a changeover means 80 described hereinbelow.

Figure 2:
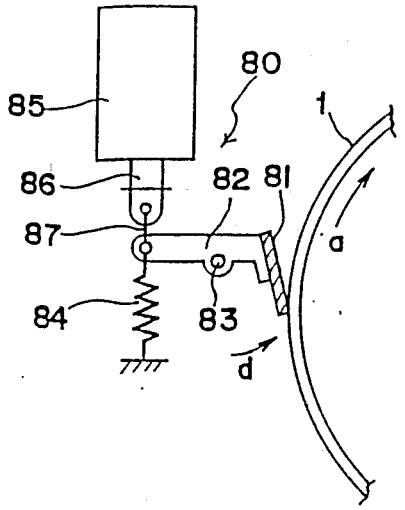
FIGS. 2 and 3 are side views of a changeover means for changing the state of a cleaning blade with respect to a photoreceptor drum.
Figure 3:
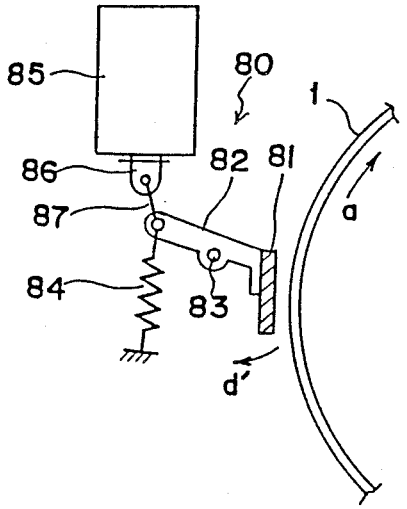

As shown in FIGS. 2 and 3, the changeover means 80 includes a lever 82 pivotable about a fulcrum 83 in both directions shown by arrows (d) and (d'). The lever 82 has one end to which the cleaning blade 81 is rigidly secured and the other end connected with one end of a compression spring 84, the other end of which is fixed to a certain stationary portion. The lever 82 is constantly biased in the direction of the arrow (d) by means of the compression spring 84. The other end of the lever 82 is further connected with a plunger 86 of a solenoid 85 through a connecting member 87.

When the solenoid 85 is off, the lever 82 is biased in the direction of the arrow (d) by the compression spring 84 so that a distal end of the cleaning blade 81 is pressed against the outer peripheral surface of the photoreceptor drum 1, as shown in FIG. 2.

In contrast, when the solenoid 85 is kept on, it effects the lever 82 to pivot in the direction of the arrow (d') against the biasing force of the compression spring 84 so that the cleaning blade 81 may move away from the photoreceptor drum 1, as shown in FIG. 3.

By using the copying apparatus A having the above described construction, a reversal image forming method for obtaining a negative image from a positive original document will be explained hereinafter according to a first embodiment of the present invention.

In a first image forming process, the second developing device 5 moves away from the photoreceptor drum 1 so that the development may not be executed, while the distal end of the separating claw piece 7 moves also away from the photoreceptor drum 1. As shown in FIG. 3, the solenoid 85 of the changeover means 80 in the cleaning device 8 is turned on to move the cleaning blade 81 away from the photoreceptor drum 1 and the eraser lamp 9 is kept off.

Under these conditions, the photoreceptor drum 1 rotates in the direction of the arrow (a) and the surface thereof is uniformly charged in the positive polarity upon discharge of the charger 2.

The exposure lamp 31 then emits light to an original document placed on the document platform 35 scanning in the direction of the arrow (b). The light reflected by the original document is applied to the surface of the charged photoreceptor drum 1 through the arrayed lenses 32. Thus, electrostatic potential of a portion corresponding to an image of the original document is left as it is and that of other background portion is erased so that the electrostatic latent image may be formed on the surface of the photoreceptor drum 1.

Figure 4:
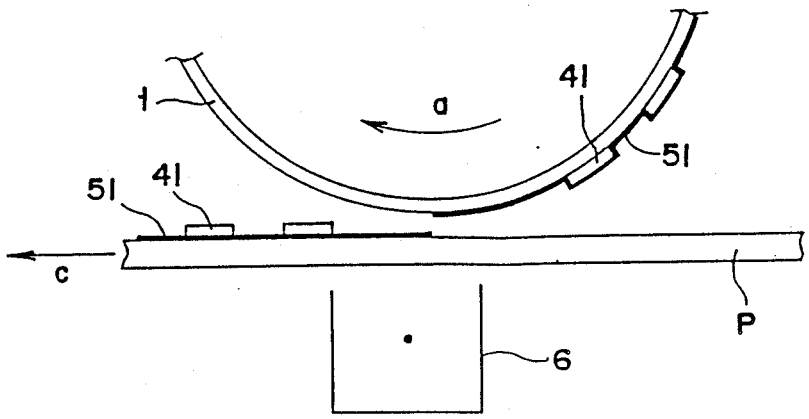
FIG. 4 is a schematic view illustrating a state in which a toner image formed on the photoreceptor drum is transferred onto a copy paper sheet.

When the electrostatic latent image has reached a location confronting the first developing device 4 upon rotation of the photoreceptor drum 1, white toner is electrostatically supplied to the electrostatic latent image to form a white toner image 41, as shown in FIG. 4.

The photoreceptor drum 1 further rotates in the direction of the arrow (a) and the white toner image 41 passes by the second developing device 5 to approach the eraser lamp 9. In the first image forming process, however, the second developing device 5, the transfer charger 6 and the eraser lamp 9 are kept out of action. On the other hand, the separating claw piece 7 and the cleaning blade 81 are kept away from the photoreceptor drum 1. Accordingly, the white toner image 41 never be disturbed or damaged by these devices or members when passing by them.

The subsequent second image forming process is executed while the document platform 35 scanned in the direction of the arrow (b) returns to its primary position.

In the second image forming process, the first developing device 4 is set in a state in which no development can be executed whereas the second developing device 5 is so set as to be able to execute the development. The image exposure device 3 is kept out of action whereas the transfer charger 6 and the eraser lamp 9 are in an operable state. The separating claw piece 7 is so set as to be able to separate a copy paper sheet from the surface of the photoreceptor drum 1.

Under these conditions, the surface of the photoreceptor drum 1 including that of the white toner image 41 is again uniformly charged in the positive polarity upon discharge of the charger 2. This process, however, differs from the previous first image forming process in that light never be applied to the image by the optical system 3 during this process. Accordingly, neither another electrostatic latent image is newly formed on the surface of the photoreceptor drum 1, nor the white toner is supplied from the first developing device 4.

Black toner is uniformly supplied onto the charged portion in the surface of the photoreceptor drum 1 at a location confronting the second developing device 5 so that the white toner 41 may be entirely covered with solid black toner image 51.

Meanwhile, the copy paper sheets P stored in the paper feed portion 20 are supplied sheet by sheet from upper side by a paper feed roller 21. Each copy paper sheet P is then transported, synchronously with the toner images 41 and 51, between the photoreceptor drum 1 and the transfer charger 6 by means of a pair of timing rollers 22. In this event, the toner images 41 and 51 are entirely transferred onto the copy paper sheet P, as shown in FIG. 4.

The copy paper sheet P with the toner images 41 and 51 transferred thereto is separated from the photoreceptor drum 1 by the separating claw piece 7 and is led to a fixing device 24 along a guide plate 23. After the toner in the toner images 41 and 51 has been fixed by the fixing device 24, the copy paper sheet P is discharged on the discharge tray 25.

On the other hand, the photoreceptor drum 1 further rotates in the direction of the arrow (a) so that residual toner may be scraped by the cleaning blade 81 of the cleaning device 8. Thus, the photoreceptor drum 1 is cleaned, and thereafter, the eraser lamp 9 emits light thereto to erase residual electrostatic charge.

In this way, the black toner image 51 is additionally formed on the white toner image 41 formed on the photoreceptor drum 1. In contrast, on the surface of the copy paper sheet P onto which such images 41 and 51 have been transferred, the white toner image 41 is located on the black toner image 51.

In other words, a reversal image reproducing the image portion in white and the background portion in black is formed on the surface of the copy paper sheet P.

Figure 5:
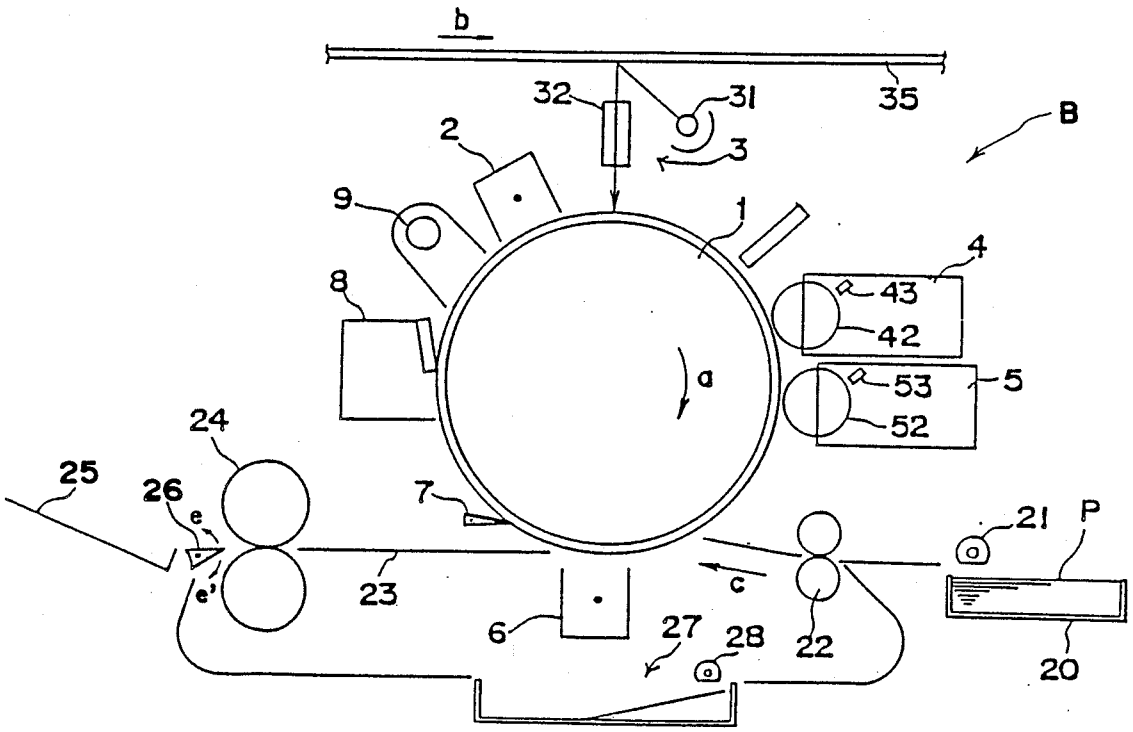
FIG. 5 is a view similar to FIG. 1, of another copying apparatus explanatory of the reversal image forming method according to a second embodiment of the present invention.

With reference to FIG. 5 illustrating a copying apparatus B having composite copying function, the reversal image forming method according to a second embodiment of the present invention will be described hereinafter.

The copying apparatus B is provided with a paper refeed device 27 at a lower portion thereof and with a changeover claw piece 26 between the fixing device 24 and the paper discharge portion 25 in addition to the aforementioned copying apparatus A. The paper refeed device 27 accommodates a paper refeed roller 28 for refeeding a copy paper sheet led into the paper refeed device 27 towards the photoreceptor drum 1.

By using the above described copying apparatus B, a negative image is formed from a positive original document during a reversal copying mode.

In the first image forming process, only the second developing device 5 is set in a state in which the development can be executed. The first developing device 4 is at a standstill or is kept away from the photoreceptor drum 1 so that the development can not be executed thereby. The image exposure device 3 is at a standstill.

Under these conditions, while the phorotoreceptor drum 1 rotates in the direction shown by the arrow (a), the surface of the photoreceptor drum 1 is uniformly charged in the positive polarity upon discharge of the charger 2.

The charged surface of the photoreceptor drum 1 then passes by the image exposure device 3 and the first developing device 4. When this surface of the photoreceptor drum 1 has reached a location confronting the second developing device 5, black toner is uniformly supplied from the second developing device 5 to this surface so that a solid black image may be formed thereon.

Meanwhile, the copy paper sheets P stored in the paper feed portion 20 are supplied sheet by sheet from upper side by the paper feed roller 21. Each copy paper sheet P is then transported, synchronously with the aforementioned toner image, into a transfer region defined between the photoreceptor drum 1 and the transfer charger 6 by means of a pair of timing rollers 22. In this event, the solid black image is entirely transferred onto the surface of the copy paper sheet P upon discharge of the transfer charge 6 so that the surface of the copy paper sheet P may be uniformly covered with the solid black toner.

This copy paper sheet P is then transported, along the transport guide 23, to the fixing device 24. After toner has been fused and fixed on the surface of the copy paper sheet P by the fixing device 24, the copy paper sheet P is directed downwards by the changeover claw piece 26 switched in a direction as shown by an arrow (e) to be stored in the paper refeed device 27.

The photoreceptor drum 1 further rotates in the direction of the arrow (a) so that residual toner may be removed therefrom by the cleaning device 8. Thereafter, light is applied to the photoreceptor drum 1 by the eraser lamp 9 to erase residual electrostatic charge remaining in the surface of the photoreceptor drum 1.

The first image forming process is followed by the second image forming process.

During the second image forming process, as is different from the first image forming process, the first developing device 4 is set in a state in which the development can be executed whereas the second developing device 5 is at a standstill or is kept away from the photoreceptor drum 1 so as to be set in a state in which the development never be executed.

Under these conditions, after the surface of the photoreceptor drum 1 has been uniformly electrostatically charged again, the image exposure device 3 emits light thereto so that an electrostatic latent image corresponding to an image formed on the original document may be formed therein. In this event, the electrostatic charge of a portion corresponding to an image portion of the electrostatic latent image is left as it is whereas that of other portion corresponding to a background portion of the electrostatic latent image is removed.

The electrostatic latent image is transported in the direction of the arrow (a), and when it passes by the first developing device 4, white toner charged in the positive polarity is supplied to the image portion of the electrostatic latent image to turn it into a visible image.

On the other hand, the copy paper sheet P on which the solid black image has been transferred during the first image forming process is transported, upon rotation of the paper refeed roller 28, upstream of the timing rollers 22 in a direction of feed of the copy paper sheet P. The copy paper sheet P is further transported to the transfer region, synchronously with the white toner image. Upon discharge of the transfer charger 6, the white toner image is transferred onto the copy paper sheet P having thereon the solid black image.

The copy paper sheet P on which the white toner image has been transferred passes the transport guide 23 and reaches the fixing device 24 where the white toner image is fused and fixed. Thereafter, the copy paper sheet P is guided by the changeover claw piece 26 switched in a direction of an arrow (e') to be discharged to the paper discharge portion 25. In this way, a reversal image having a white image portion and a black background portion is formed on the copy sheet P.

It is to be noted here that in the case where the white toner image is transferred onto the copy paper sheet, if the amount of white toner adhered thereto is substantially the same as that of toner contained in black toner image or in any other colored toner image, a ground color of the sheet can be viewed through the toner image. Particularly, this becomes conspicuous when an area image having many a solid portion is copied.

Accordingly, in the reversal image forming method according to the present invention, it is necessary to render the amount of adhesion of white toner per unit area to be greater than that of black toner or any other colored toner.

To this end, there are several methods which will be described hereinafter.

First Method

A gap Ds for development formed between the photoreceptor drum 1 and the developing sleeve 42 of the first developing device 4 is rendered smaller than another gap Ds' for development formed between the photoreceptor drum 1 and the developing sleeve 52 of the second developing device 5.

Figure 6:
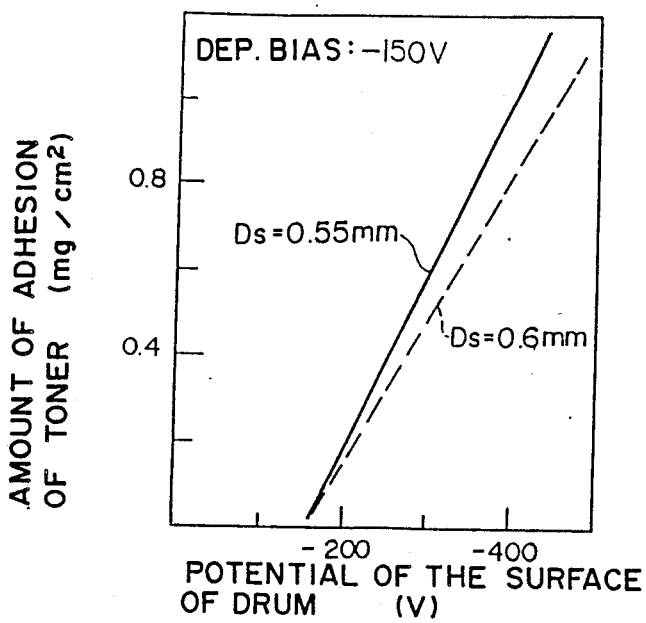
FIGS. 6 and 7 are graphs showing the relationship between the amount of adhesion of toner and electric potential applied to the surface of the photoreceptor drum.

More specifically, when the gap Ds is reduced from 0.6 mm to 0.55 mm, the amount of adhesion of white toner can be increased, as shown in a graph of FIG. 6.

Second Method

A gap Db for bristle height regulation formed between the developing sleeve 42 and the bristle height regulation member 43 is rendered larger than another gap Db' for bristle height regulation formed between the developing sleeve 52 and the bristle height regulating member 53.

More specifically, when the gap Db is widened from 0.5 mm to 0.55 mm, the amount of adhesion of white toner can be increased as similar to the result of the first method.

Third Method

The amount of developer to be transported into a developing region defined between the photoreceptor drum 1 and the developing sleeve 42 is rendered to increase by increasing the number of rotation of the developing sleeve 42 as compared with that of the developing sleeve 52 of the second developing device 5.

More specifically, in the case where the developing sleeve having an outer diameter of 24.5 mm is used, when the number of rotation thereof is increased from 143.64 rpm to 170 rpm, the amount of adhesion of white toner can be increased as similar to the result of the first method.

Fourth Method

Bias voltage Vb for development applied to the developing sleeve 42 is rendered less than another bias voltage Vb' for development applied to the developing sleeve 52 of the developing device 5.

Figure 7:
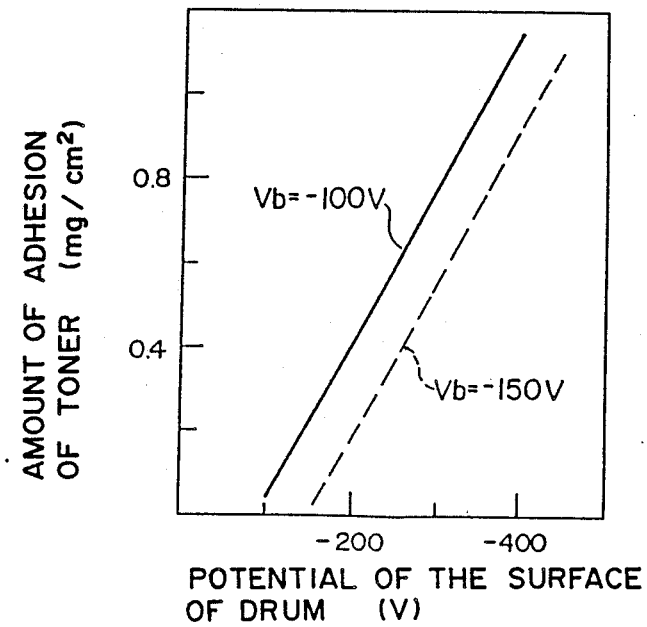

More specifically, when the bias voltage Vb is changed from −150V to −100V, the amount of adhesion of white toner can be increased as shown by a graph of FIG. 7.

Figure 8:
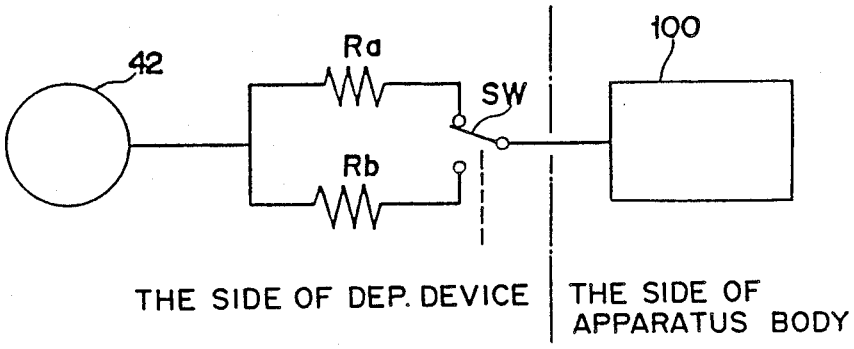
FIG. 8 is an electric circuit for changing bias voltage for development to be applied to a developing sleeve of a developing device accommodated in the copying apparatus.

FIG. 8 illustrates one example of an electric circuit for changing the bias voltage Vb for development to be applied to the developing sleeve 42. In the circuit of FIG. 8, the developing sleeve 42 is electrically connected, through a switch SW and either one of two resistors Ra and Rb, with an output transformer 100 for the bias voltage provided in the main body of the copying apparatus. The resistor Ra has a smaller resistance than the resistor Rb has. When the first developing device 4 accommodates white toner, the developing sleeve 42 and the output transformer 100 are connected with each other by way of the resistor Rb. On the other hand, when the first developing device 4 accommodates black toner or any other colored toner, the developing sleeve 42 and the output transformer 100 are connected with each other by way of the resistor Ra having a smaller resistance. This changeover is conducted by the switch SW. In this way, the bias voltage for development is lessened when the developing device accommodates white toner.

Fifth Method

During the first image forming process, that is to say, during the development by white toner, voltage to be charged by the charger 2 is raised so that potential difference between it and the bias voltage Vs for development may be rendered relatively large. In contrast, during the second image forming process, that is to say, during the development by black toner, the potential difference is lowered down to the normal level. Thus, the amount of adhesion of white toner is increased as cmopared with that of black toner.

As is clear from the above, according to the reversal image forming method of the present invention, the reversal image can be formed by using the conventional copying apparatus without the necessity of further providing the charger, the transfer charger and the like in addition thereto. A fascinating or attractive image which is splendid in design can be also formed by making a good use of the method according to the present invention. The present invention, therefore, can further enhance the utility value of the copying apparatus.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A reversal image forming method comprising the steps of:

uniformly charging a photosensitive member;

forming an electrostatic latent image in a charged surface of said photosensitive member;

developing said electrostatic latent image formed on said photosensitive member by using white toner;

uniformly charging said photosensitive member again;

uniformly developing the surface of said photosensitive member by using other toner different in color from the white toner; and transferring the toner image formed on said photosensitive member onto a paper sheet.

2. The reversal image forming method as claimed in claim 1, wherein said other toner is black toner.

3. The reversal image forming method as claimed in claim 1, further comprising the step of fixing said toner image transferred onto said paper sheet.

4. A reversal image forming method comprising the steps of:

uniformly charging a photosensitive member;

uniformly developing a charged surface of said photosensitive member by using a toner of a color different from white;

transferring the toner image formed on said photosensitive member onto a paper sheet and fixing the image thereon;

uniformly charging said photosensitive member again;

forming an electrostatic latent image in the charged surface of said photosensitive member;

developing said electrostatic latent image formed on said photosensitive member by using white toner which is different in color from said toner; and transferring the white toner image formed on said photosensitive member onto said paper sheet having thereon said toner image.

* * * * *